US006138945A

United States Patent [19]

Biggers et al.

[11] Patent Number: 6,138,945

[45] Date of Patent: Oct. 31, 2000

[54] NEURAL NETWORK CONTROLLER FOR A PULSED ROCKET MOTOR TACTICAL MISSILE SYSTEM

[76] Inventors: James E. Biggers, 2371 N. Lake Star Dr.; Kevin P. Finn, 9190 E. Kayenta Dr., both of Tucson, Ariz. 85749; Homer H. Schwartz, II, 1989W DSRT, Highlands Oro Valley, Ariz. 85737

[21] Appl. No.: 09/004,993

[22] Filed: Jan. 9, 1998

Related U.S. Application Data

[60] Provisional application No. 60/035,802, Jan. 9, 1997.

[51] Int. Cl.[7] ..... F41G 7/00

[52] U.S. Cl. ..... 244/3.22; 244/164; 244/169; 102/215

[58] Field of Search ..... 244/3.22, 3.21, 244/3.15, 164, 169; 102/215

[56] References Cited

U.S. PATENT DOCUMENTS

| | | | |
|---|---|---|---|
| 3,866,025 | 2/1975 | Cavanagh | 244/169 |
| 3,973,499 | 8/1976 | Anderson et al. | 102/200 |
| 4,085,584 | 4/1978 | Jones et al. | 60/250 |
| 4,408,735 | 10/1983 | Metz | 244/3.22 |
| 4,999,997 | 3/1991 | Grosgebauer et al. | 60/256 |
| 5,155,801 | 10/1992 | Lincoln | 706/20 |
| 5,238,204 | 8/1993 | Metz | 244/3.22 |
| 5,406,290 | 4/1995 | James et al. | 342/119 |
| 5,456,425 | 10/1995 | Morris et al. | 244/3.22 |
| 5,602,964 | 2/1997 | Barrett | 395/24 |

*Primary Examiner*—Harold J. Tudor

*Attorney, Agent, or Firm*—David W. Collins; Andrew J. Rudd; Glenn H. Lenzen, Jr.

[57] ABSTRACT

A neural network controller for a pulsed rocket motor tactical missile. The missile includes a fuselage or body, with a propulsion system. The pulsed propulsion system has a need for a logical control of the application of propulsion energy throughout the missile's flight. The controller is trained to provide optimal initiation of individual rocket motor thrust pulses based on tactical information available at various points/times in the missile's flight. The controller training is through use of training cases, in which the network learns to output a specific target value(s) when specific values are input. When trained with a large sample of training cases selected from the multidimensional population of interest, the neural network effectively learns the correlations between inputs and outputs and can predict input/output relationships not previously seen in any training case.

14 Claims, 5 Drawing Sheets

NEURAL NETWORK CONTROLLER FOR A PULSED ROCKET MOTOR TACTICAL MISSILE SYSTEM

This application claims benefit of provisional application Ser. No. 60/035,802 filed Jan. 9, 1997.

TECHNICAL FIELD OF THE INVENTION

The present invention relates to tactical guided missiles, and more particularly to a guided missile having a propulsion system designed to provide incremental or "pulsed" output.

BACKGROUND OF THE INVENTION

A guided missile of this sort includes a fuselage or body, with a propulsion system that is usually located in the rear or tail of the fuselage. A pulsed propulsion system can take the form of a solid-propellant or liquid-propellant engine, or a hybrid of the two. Common among them, however, is the need for logical control of the application of propulsive energy throughout the missile's flight. The missile incorporates additional guidance and control functions which produce movement of aerodynamic control surfaces and/or supplemental thrusting subsystem(s) to direct the course of the missile.

There is a desire to improve the performance of such a missile by increasing its speed, range and maneuverability. For example, a high-energy fuel is utilized, and outward characteristics of the fuselage are designed to minimize drag which slows the missile. Likewise, the path the missile is commanded to take towards its destination is engineered to minimize effects of gravitational pull and adverse tracking phenomena associated with the target tracking technology (e.g. radar, infrared, etc.) employed. Control of on-board sub-systems must be accomplished by electronic assemblies which conform to stringent weight, volume and power requirements and through the use of extremely efficient software which does not unduly load on-board data processing equipment, also designed within tight requirement constraints.

There exists, within the art of guided missile design, a goal of optimizing various "kinematic" performance criteria, within the constraints presented by physical aspects of various missile subsystems. In dealing with performance objectives related to most guided missiles, such constraints are typically severe and profoundly influential on the nature of resulting missile designs. For example, propulsive energy available at different times in a missile's flight is heavily linked to the allocated volume and mass property limits in which a propulsion designer is allowed to work. Various known techniques exist within this discipline to enhance and optimize propulsive output within volumetric and weight constraints associated with guided missile airframe designs; among them are the use of high-energy propellant chemical formulations and specifically-tailored propellant grain geometries.

Another technique that has the potential of contributing to enhanced kinematic performance involves the use of various motor design techniques of producing sequential and separate increments of motor thrust output, which will be referred to herein as a "pulsed motor" or "pulsed motor technology," such as described, for example in U.S. Pat. Nos. 3,973,499, 4,085,584 and 4,999,997. This may be accomplished through solid-propellant motor designs with physically separated propellant grains or through other means.

In solid-propellant rocket motors, such approaches allow for short duration, high pressure combustion of propellants which tends to maximize performance output achieved by a given mass of propellant. Such techniques allow for selective release of propulsive energy at optimum points along a missile's flight trajectory, so as to allow desirable guidance and/or control performance in the various phases of target acquisition, tracking and terminal homing of the missile on its intended target.

A problem, however, has traditionally existed in the implementation of pulsed motor technology in guided missiles. The numerous variables involved in the characterization of specific tactical scenarios (e.g. launcher and target locations, velocities and post-launch maneuvers) contribute to enormously complex physical relationships, which are further complicated by varying uncertainties in associated measurements of these factors. Even if the physical relationships were well understood, the implementation must contend with the infinite number of combinations of variables. Indeed, while pulsed motor technology would seem to be well-suited to the challenges of guided missile design, its use has been severely limited by a lack of means by which pulse timing may be optimized for widely-varying launch/engagement criteria. Fixing the timing of sequential motor pulses may produce very effective performance in some tactical scenarios, but is likely to produce lackluster performance in others. A need for scenario-specific control of such motors is thus critical to their effective utilization.

No known pulsed motor tactical air-to-air or air intercept missiles exist today. As stated above, pulsed motor tactical missiles have not been produced because, among other things, no suitable method for controlling the pulse had been identified. There is, therefore, a need for a missile having improved performance obtainable through sequentially-pulsed -motor technology with adaptable control of motor pulse timing as appropriate for optimal achievement of multiple performance objectives specific to each tactical situation. The neural network control device embodied in this invention accomplishes this function, making system implementation of pulsed motor technology in guided missiles an achievable feat.

SUMMARY OF THE INVENTION

A guided missile system is described, which includes a missile body and a pulsed propulsion system comprising a first thrust pulse unit and a second thrust pulse unit. The propulsion system is responsive to sequential propulsion control signals provided a pulsed propulsion output. In accordance with the invention, the missile system further includes an on-board neural network controller responsive to a plurality of input condition signals for providing a propulsion signal to the second thrust pulse unit to actuate the second unit at an optimal time in dependence on a set of input conditions determined at missile launch.

In an exemplary embodiment, the neural network controller comprises a multilayer feedforward network having a single hidden layer and a nonlinear quashing function.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

In accordance with an aspect of the invention, a specifically-trained neural network pulsed motor control device is employed, which is trained to provide optimal initiation of individual rocket motor thrust pulses based on tactical information available at launch, and in an adaptive form at various points/times in a missile's flight. Neural networks, which can exist in either physical (hardware) or logical (software) embodiments, imitate the biological functions observed in human brain cells in making decisions based on numerous input criteria which may vary in importance and cross-dependency. Such devices may be effectively "trained" through use of training cases, in which the network learns to output a specific target value(s) when specific values are input. When trained with a large sample of training cases selected from the multidimensional population of interest, the neural network effectively learns the correlations between inputs and outputs and, with surprising accuracy, can predict input/output relationships not previously seen in any training case.

A neural network can be "trained" prior to its tactical use. By thoroughly sampling the design space with respect to possible tactical engagement scenarios in laboratory computer simulations, a neural network can effectively "learn" the outcomes of many combinations of input situations. In doing so, a theoretically infinite amount of information can effectively be built in to a compact neural network prior to its operational activation. Benefit from prior analyses emerges at that time through output decision criteria as to the best time(s) to initiate sequential motor pulses for maximum missile kinematic performance in a specific missile engagement situation.

This invention's application of neural networks for the decision of motor pulse timing in guided missiles allows the sum of knowledge gained in lengthy laboratory studies to be ingrained in the architecture of the network, available almost instantaneously for a rapid, efficient computation of the "best" motor pulse timing for a given launch.

Figure 1:
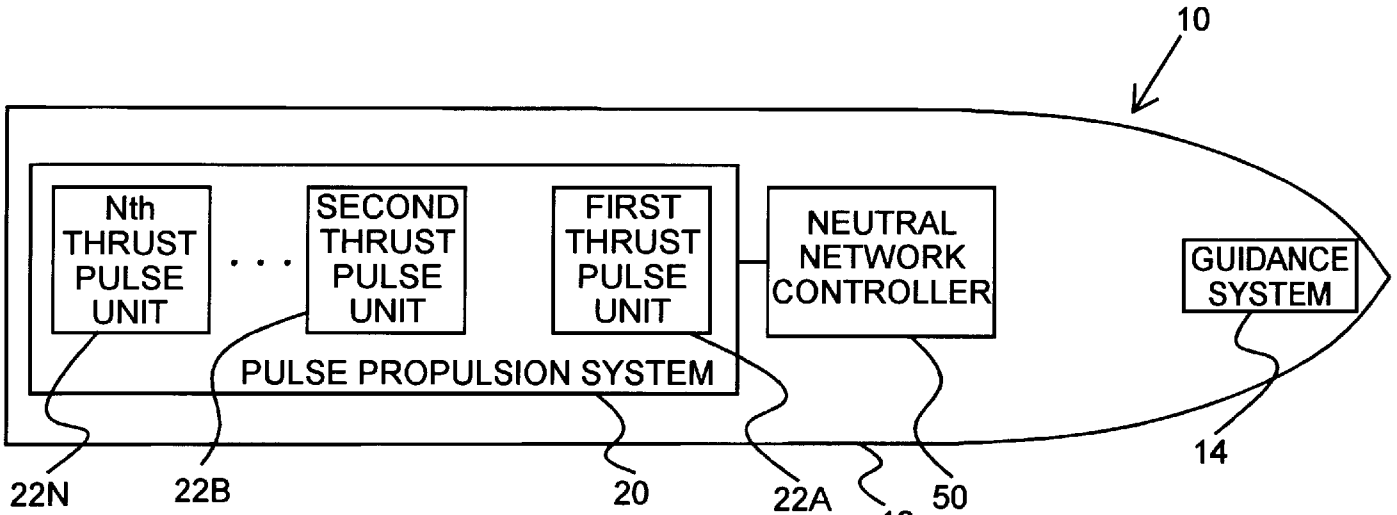
FIG. 1 is a simplified diagrammatic illustration of aspects of a pulsed motor missile embodying the invention.

This invention involves the incorporation of a neural network as a controller for a pulsed motor tactical missile system. FIG. 1 is a simplified diagrammatic view of a pulsed motor tactical missile system 10 embodying the invention. The missile system includes a missile body 12 which houses the internal missile sub-systems, including the propulsion system and the missile guidance system 14. In accordance with the invention, the missile system 10 includes a pulsed motor propulsion system 20, which includes a first thrust pulse unit 22A, a second thrust pulse. unit 22B . . . and an Nth thrust pulse unit 22N, producing sequential and separate increments of motor thrust output. The first thrust pulse unit 22A is typically fired or actuated at missile launch, and operates for some period of time. The second thrust unit 22B will be actuated at a time subsequent to launch, at a time determined by the neural network controller 50. Other missile sub-systems will accomplish other guidance and control functions during flight, in the conventional manner, and are not described further herein.

The neural network controller 50 selected for use in the exemplary embodiment described herein implements a multilayer feedforward network with a single hidden layer and a nonlinear squashing function. This exemplary network is one of the most stable neural networks. However, other types of neural networks could alternatively be used. For example, a multilayer feedforward network with multiple hidden layers, while adding considerable complexity, could alternatively be used. This neural network is defined analytically as follows:

$$\text{Optimum Pulse Time} = \sum_j \left[\beta_j g\left(\theta_j + \sum_i (\gamma_{ij} x_i)\right)\right] \text{ where } g(u) = \frac{1}{1+\exp(-u)}$$

The above feedforward network weights the inputs, x, by use of input layer coefficients, $\gamma_{ij}$, and feeds the sums of all weighted products into each hidden node, where the sum of the weighted terms is offset by a bias, $\theta$. The offset sum of the weighted terms is operated on by the nonlinear squashing function, g, which in this exemplary case is a logistics function. Other squashing functions could alternatively be employed, e.g., a guassian or polynomial squashing function, although the logistics function has been used for many applications and is known to be quite stable. The response of each hidden node is the output of the nonlinear squashing function. The hidden node outputs are weighted by the output layer coefficients, $\beta$. The weighted terms from each node are summed to produce the output, which, in this exemplary embodiment is the optimum time to ignite the second motor pulse. Alternatively, the network could be trained to output a command based on missile time, i.e. adding the time of the first pulse and the delay time, or to output a logical output such as a zero magnitude until the time to fire the second or subsequent pulse, at which time a logic one signal is output, with the second pulse fired on the transition.

Figure 2:
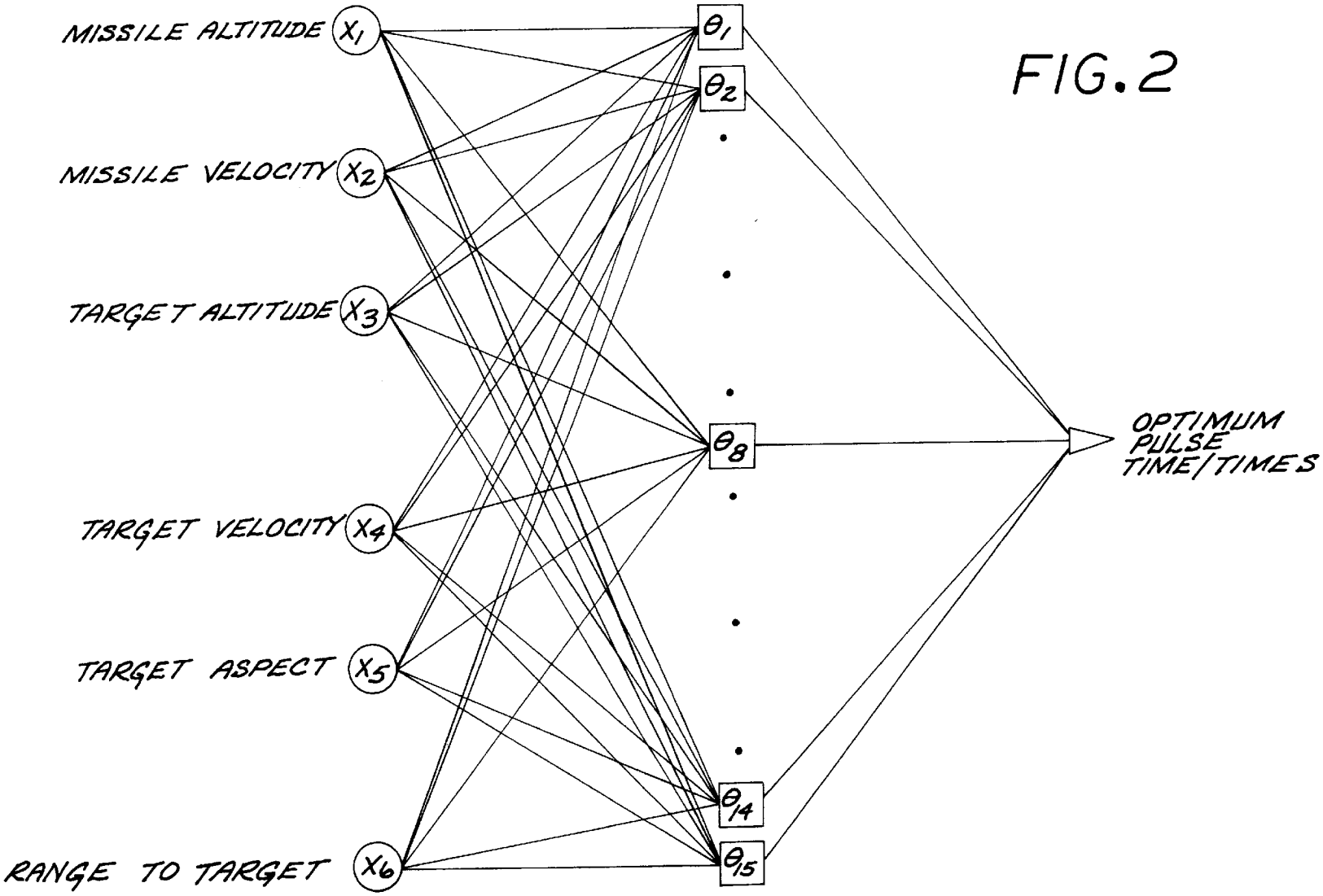
FIG. 2 is a graphical representation of a neural network controller comprising the missile of FIG. 1.

A graphical representation of this neural network is shown in FIG. 2. The neural network incorporates six inputs, fifteen nodes, and one output which is the optimum time to fire the second rocket motor pulse. The first two inputs are missile conditions, i.e. the missile altitude and velocity. The remaining four inputs are target observables, i.e. target altitude and velocity, target range, and target aspect.

A neural network as used in this exemplary embodiment of a pulsed motor controller was trained with a set of 485 training cases. These cases were selected from a population of launch conditions that bounded the pulse motor missile launch envelope. The launch envelope dimensions bounded were the launch aircraft altitude, the launch aircraft velocity, the target aircraft altitude, the target aircraft initial velocity, the target aircraft maneuver including no maneuver, the target aircraft acceleration and final velocity, the launch aspect, and the launch range. The training took place on a desktop PC and after approximately 40 hours of training the network errors were decreased to an acceptable value and the neural network coefficients were saved.

Figure 3:
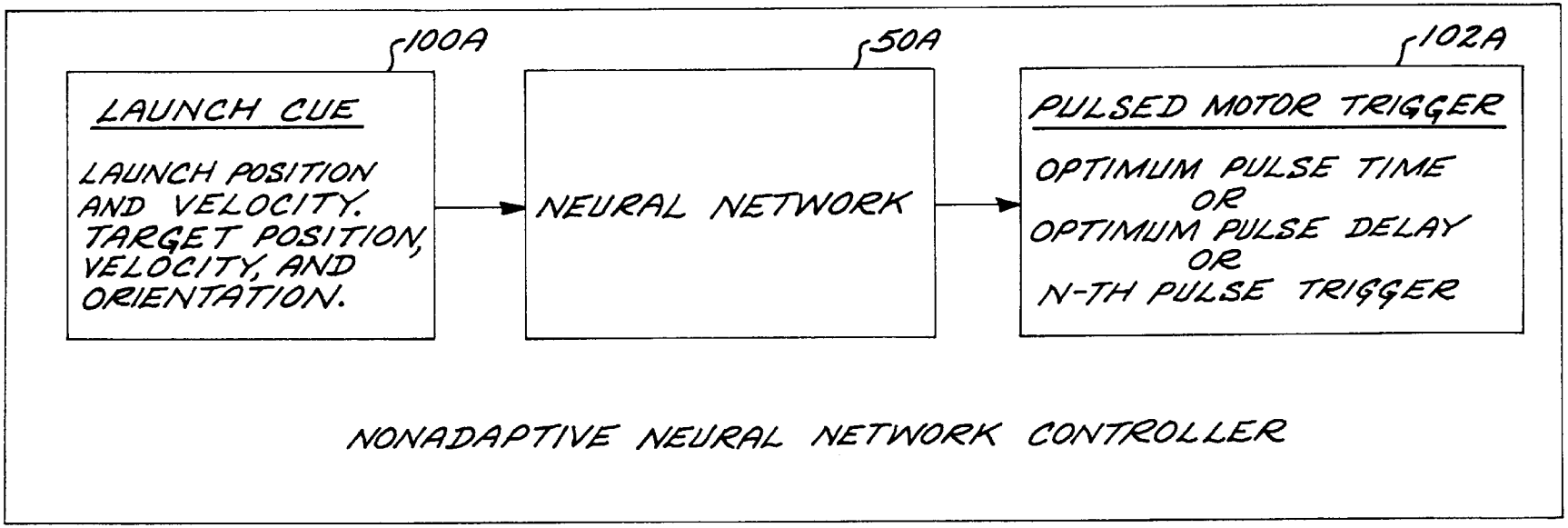
FIG. 3 is a schematic depiction of a nonadaptive form of neural network controller.

The neural network illustrated in FIG. 2 can be implemented as a nonadaptive neural network controller, wherein the output will be determined from a set of parameters set at launch, i.e. "launch cues," or as an adaptive neural network controller, wherein the output is determined as a result of launch cues as well as data received via a data link from the launch aircraft and observable data determined from on-board sensors. FIG. 3 is a schematic depiction of a nonadaptive controller 50A, wherein the inputs are the set 100A of launch cues, including the launch aircraft position and velocity at time of launch, and the target position, velocity and orientation at time of launch. The neural network 50A has the same form as illustrated in FIG. 2, and produces an output 102A used as the pulsed motor trigger signal. This output can take the form of an optimum pulse time, or an optimum pulse delay from the trigger of the prior or first motor pulse, or the N-th pulse trigger to trigger the N-th motor pulse.

Figure 4:
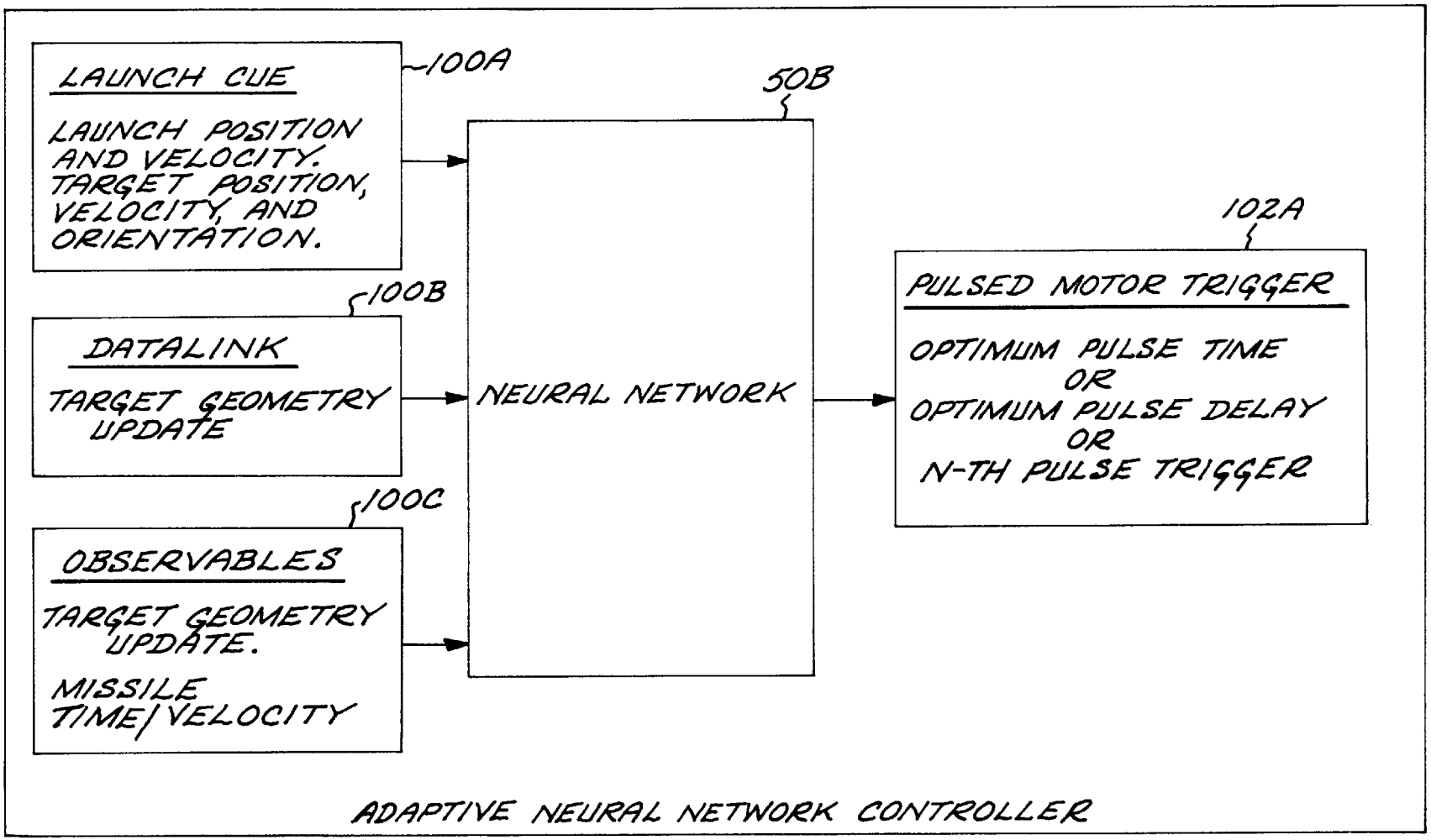
FIG. 4 is a schematic diagram illustrating an adaptive form of neural network controller.

FIG. 4 is a schematic diagram illustrating an adaptive neural network controller 50B, wherein the inputs are the set 100A of launch cues as in the embodiment of FIG. 3, and additionally target geometry update data 100B received over a datalink between the missile and a control source, e.g. the launch aircraft, and observable data 100C from sensors on board the missile or from remotely located sensors such as global positioning satellites (GPS). This observable data includes target geometry update data, learned for example from an on-board radar system, and missile time (i.e. the time interval from missile launch) and velocity. This input data is processed through the neural network 50B, which outputs the pulsed motor trigger output(s) 102A, which can take the same form as the pulsed motor trigger output 102A of FIG. 3.

Benefits of this invention lie largely in two areas. First, the embodiment of neural networks in electronic circuit (hardware) designs greatly lends itself to application in space- and weight-limited tactical missiles, through use of existing techniques in the development and manufacture of semiconductor electronic circuitry. Weight, power and volumetric constraints therefore support the physical embodiment of neural networks, which are very compact and efficient in microelectronic form. Likewise, when embodied in a logical (arithmetic) device, neural network relationships between multiple input expressions reduce to an extremely compact and efficient form. This approach, as manifested in a software device, suits itself well to the programming and execution constraints of tactical missile data processing equipment, which is typically limited in computational throughput as well as on-board memory capacity. This is due in part to the physical constraints already described and in part to the multiplicity of competing computational tasks which must be performed throughout a tactical missile's flight to guide and control the weapon.

Figure 5:
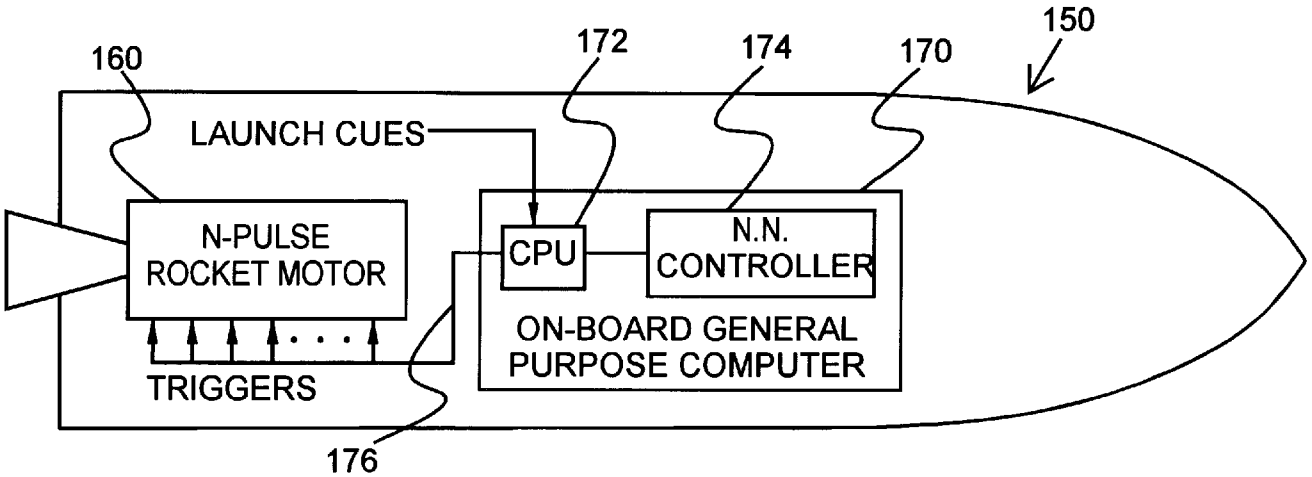
FIG. 5 is a schematic block diagram of a missile system including an on-board general purpose computer for implementing a neural network controller in software.
Figure 6A:
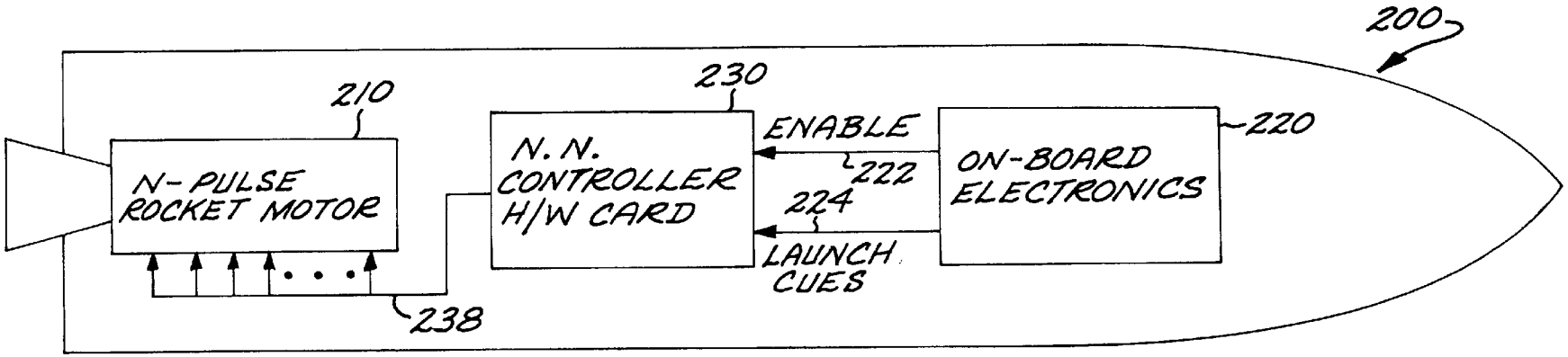
FIG. 6A is a schematic block diagram of a missile system including a neural network controller constructed on a hardware circuit card.
Figure 6B:
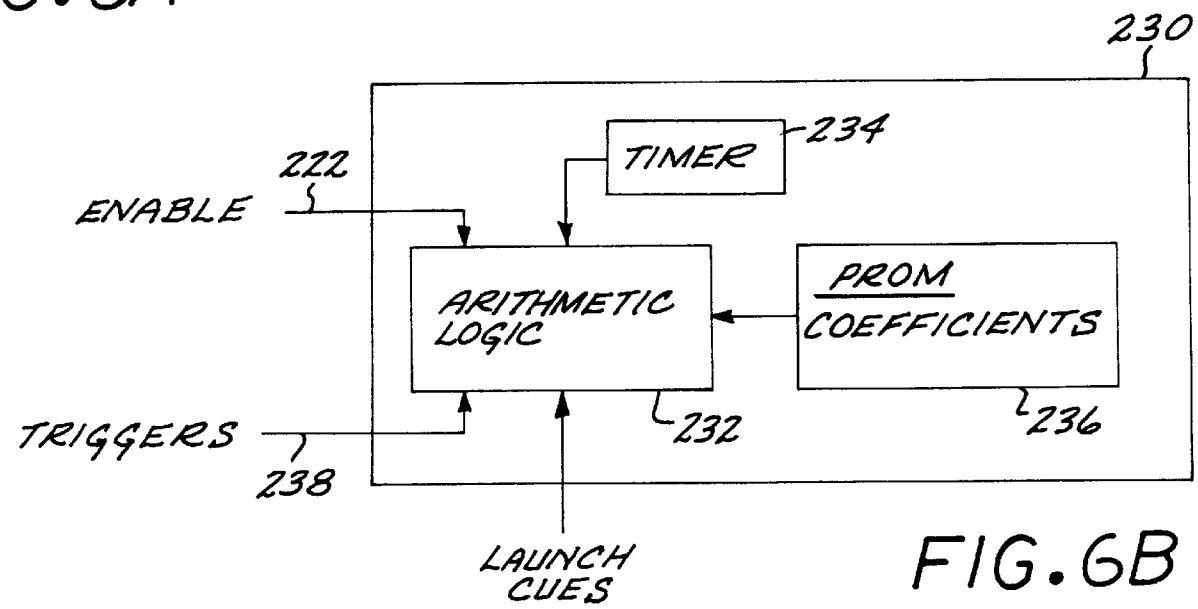
FIG. 6B is a simplified schematic block diagram of an exemplary form of the hardware circuit card of FIG. 6A.

To further illustrate possible implementations of the invention, FIGS. 5 and 6A–6B show exemplary missile system embodiments employing respective software and hardware embodiments of the neural network controller for controlling an N-pulse propulsion motor. The missile system 150 of FIG. 5 includes the N-pulse rocket motor 160, and an on-board general purpose computer 170 which controls various missile functions. The computer 170 includes a central processing unit (CPU) 172 and a neural network controller 174. The CPU is responsive to input information including a set of launch cues. The neural network controller 174 is embodied in software comprising the computer 170, and is accessed by the CPU 172 to carry out the function of determining the control trigger signals 176 for activating the N pulses of the motor 160. The software embodiment of FIG. 5 is particularly useful for missiles having a relatively large on-board computing and memory capacity.

FIG. 6A illustrates a missile system 200 including an N-pulse motor 210. The missile 200 includes an on-board electronics package 220, which controls various missile functions, including enabling a neural network hardware card 230 by an enable signal 222. The package 220 also provides a set 224 of launch cues to the card 230. The hardware card 230 can take the form of a hardware circuit card or module including circuits for implementing the neural networks, and generates the trigger signals 238 for triggering the pulses of the motor 210.

FIG. 6B is a simplified schematic block diagram of an exemplary form of the hardware card 230. The card includes an arithmetic logic module 232 which receives the enable command and the launch cues, a timer 234, and a programmable read only memory (PROM) 236 in which are stored the neural network coefficients. With a PROM storing the coefficients, a missile can be quickly and easily reprogrammed with a different set of coefficients.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A guided missile system, comprising:

a fuselage;

a pulsed propulsion system comprising an N-pulse motor system for sequentially producing successive thrust pulses in response to pulse trigger commands to provide a pulsed propulsion output; and an on-board neural network controller responsive to a plurality of input condition signals for providing pulse trigger commands to control at least one of said thrust pulses at an optimal time in dependence on a set of input conditions.

2. The missile system of claim 1 wherein said neural network controller comprises a multilayer feedforward network having a single hidden layer and a nonlinear quashing function.

3. The missile system of claim 2 wherein said multilayer feedforward network is characterized by the relationship $$\text{Optimum Pulse Time} = \sum_j \left[\beta_j g\left(\theta_j + \sum_i (\gamma_{ij} x_i)\right)\right],$$

where x represents the input conditions, $\gamma_{ij}$ represents the input layer coefficients, $\beta$ represents the output layer coefficients, $\theta$ represents an offset bias, and g represents said nonlinear squashing function.

4. The missile system of claim 3 wherein said nonlinear squashing function is the logistics function represented by $$g(u) = \frac{1}{1 + \exp(-u)}.$$

5. The missile system of claim 1 wherein said neural network controller is a nonadaptive controller, and wherein said input conditions consist of a set of launch cues.

6. The missile system of claim 5 wherein said launch cues include missile launch position and velocity, and target position, velocity and orientation at missile launch.

7. The missile system of claim 1 wherein said neural network controller is an adaptive controller, and wherein said input conditions include a set of launch cues and a set of observable data received after missile launch, said observable data including target geometry update data.

8. The missile system of claim 7 wherein said launch cues include missile launch position and velocity, and target position, velocity and orientation at missile launch.

9. The missile system of claim 1 further comprising an on-board general purpose computer including a central processing unit, and wherein said neural network controller is a software module executed by said central processing unit.

10. The missile system of claim 1 further comprising an on-board electronics package, and hardware module, and wherein said neural network controller is defined by said hardware module, said module including a read only memory unit storing a set of predetermined neural network coefficients.

11. A guided missile system, comprising:

a fuselage;

a pulsed propulsion system comprising a first thrust pulse unit and a second thrust pulse unit, said system responsive to sequential propulsion control signals to provided a pulsed propulsion output; and an on-board neural network controller responsive to a plurality of input condition signals for providing a propulsion signal to said second thrust pulse unit to actuate said second unit at an optimal time in dependence on a set of input conditions determined at missile launch.

12. The missile system of claim 11 wherein said neural network controller comprises a multilayer feedforward network having a single hidden layer and a nonlinear quashing function.

13. The missile system of claim 11 wherein said multilayer feedforward network is characterized by the relationship $$\text{Optimum Pulse Time} = \sum_j \left[\beta_j g\left(\theta_j + \sum_i (\gamma_{ij} x_i)\right)\right],$$

where x represents the input conditions, $\gamma_{ij}$ represents the input layer coefficients, $\beta$ represents the output layer coefficients, $\theta$ represents an offset bias, and g represents said nonlinear squashing function.

14. The missile system of claim 13 wherein said nonlinear squashing function is the logistics function represented by $$g(u) = \frac{1}{1 + \exp(-u)}.$$

* * * * *